US005740752A

United States Patent [19]

Allenbaugh

[11] Patent Number: 5,740,752

[45] Date of Patent: Apr. 21, 1998

[54] APPARATUS FOR DOCKING BOATS TO EACH OTHER

[76] Inventor: Howard M. Allenbaugh, 19525 Woodlands La., Huntington Beach, Calif. 92648

[21] Appl. No.: 673,663

[22] Filed: Jun. 25, 1996

[51] Int. Cl.[6] ..... B63B 21/00

[52] U.S. Cl. ..... 114/230; 114/219; 405/221

[58] Field of Search ..... 114/230, 231, 114/242, 249, 250, 258, 259, 263, 219; 405/212, 221

[56] References Cited

U.S. PATENT DOCUMENTS

| | | | |
|---|---|---|---|
| 3,464,214 | 9/1969 | King . | |
| 3,842,779 | 10/1974 | Jaynes . | |
| 5,036,784 | 8/1991 | Wagner . | |
| 5,487,349 | 1/1996 | Andreassen . | |
| 5,560,312 | 10/1996 | McPherson | 114/219 |

OTHER PUBLICATIONS

West Marine Catalog, p. 197.

*Primary Examiner*—Jesus D. Sotelo
*Attorney, Agent, or Firm*—Knobbe, Martens, Olson, & Bear, LLP

[57] ABSTRACT

An apparatus for docking a smaller vessel, such as a dinghy, to a substantially horizonal platform or swimstep of a larger vessel, such as a boat. The docking apparatus comprises a pair of mounting brackets attached at spaced locations to the edge of the swimstep. A substantially vertical bumper attached to each mounting bracket extends vertically above and below the swimstep. An adjustment bracket connected between each bumper and mounting bracket permits vertical, horizontal and rotational adjustment of the bumper with respect to the swimstep. For soft dinghies, a line connected to the dinghy and the bumper docks the two together. For hard dinghies, the bumper includes a cushion interposed between the bumper and the hard dinghy.

18 Claims, 6 Drawing Sheets

APPARATUS FOR DOCKING BOATS TO EACH OTHER

BACKGROUND OF THE INVENTION

The present invention relates to devices for docking boats to each other and, more particularly, to an apparatus for docking a smaller boat to the swimstep of a larger boat.

It is a common practice for relatively large vessels or boats to carry a smaller vessel, such as a dinghy, for use in transporting passengers to and from the boat. For example, when the boat is anchored in a harbor, the dinghy can be used to transport passengers to shore, to another boat in the harbor, or to some other destination. Various means may be employed to carry the dinghy on the boat when the boat is traveling at sea, on a lake, or another body of water. Alternatively, the dinghy may be docked at shore and commissioned when necessary to transport passengers from an anchored boat.

When the dinghy is used to load or unload passengers from the boat, the dinghy must be docked or somehow secured to the boat during the loading/unloading process. If the dinghy is not securely docked to the boat, the passengers could be injured as they attempt to leave the boat and enter the dinghy, or vice versa. For example, if the dinghy is unstable and moves away from the boat, a passenger could lose balance and fall, perhaps striking the boat or the dinghy during the fall. An unstable dinghy also could result in a passenger falling into the water.

Although the dinghy can be docked to the boat at various locations, one common docking location is the swimstep at the rear or stern of the boat. In this docking location, one side of the boat is positioned alongside the outermost edge of the swimstep. This orientation between the boat and the dinghy tends to offer the most stability by allowing the bow and stern of the dinghy to be secured at spaced-apart locations on the swimstep. It also makes it generally easier for passengers to step between the swimstep and the side of the dinghy.

While docking of the dinghy to the boat may not pose problems in calm waters, significant problems have arisen in the past when it has been necessary to dock the dinghy to the boat in relatively rough or choppy water. One typical problem occurs when there is relative vertical motion between the boat's swimstep and the side of the dinghy. Many dinghies are docked to swimsteps in a relatively crude manner by ropes, which tend to have some slack. Moreover, the swimstep is usually a relatively thin platform that offers little by way of vertical stability. As a result, a passing wave or choppy water can move the swimstep and the dinghy up and down relative to each other. During this motion, which may produce relative vertical motion of several feet between the swimstep and dinghy, the dinghy may move underneath the swimstep. Over a prolonged period of docking under these circumstances, the dinghy and the swimstep can repeatedly bang into each other and result in significant damage to the swimstep, the dinghy, or both.

Over the years, various methods have been devised to secure a dinghy to a swimstep. The rope method referred to above simply involves typing ropes to the dinghy and the swimstep. Another method involves mechanically securing the dinghy to the swimstep by metal brackets that are slidably fastened to each other. One bracket is connected to the swimstep and another bracket that slidably mates with the first bracket is connected to the dinghy, with a pivot point in between. However, this pivoting type of connection, while it helps to prevent the damage referred to above, is relatively inflexible and difficult to use in actual practice.

Other types of connections have been developed, but they tend to solve the problems of instability and damage referred to above with relatively complicated connections that, in some instances, pose undesirable problems of their own, especially when attempting to dock the dinghy.

Accordingly, a definite need has existed for an apparatus that can securely dock a dinghy or other small vessel to the swimstep of a larger vessel or boat, which provides safe loading and unloading of passengers, which is easy and convenient to use, and which helps prevent damage to the dinghy and the boat's swimstep in rough waters. The present invention satisfies these and other needs, and provides further related advantages.

SUMMARY OF THE INVENTION

The present invention provides a docking apparatus for docking a smaller vessel to a substantially horizontal platform of a larger vessel. In particular, the docking apparatus is especially adapted to dock a dinghy to the swimstep of a boat. One embodiment of the docking apparatus is suited for docking soft dinghies, and another embodiment is suited for docking hard dinghies.

In general, the docking apparatus comprises a pair of mounting brackets attached at spaced locations to an outer end of the swimstep. A substantially vertical bumper is attached to each mounting bracket, such that the bumper can be adjusted to extend vertically above and below the swimstep. If the dinghy is a soft dinghy, a line is provided for connecting the soft dinghy securely against each bumper. In this way, the soft dinghy is securely docked to the swimstep of the boat. If the dinghy is a hard dinghy, the bumper is provided with a cushion attached to the bumper. The cushion provides a buffer between the hard dinghy and the bumper to prevent damage to the hard dinghy.

In one aspect of the invention, an adjustment bracket connects each bumper to its associated mounting bracket. The adjustment bracket is adapted to provide vertical, horizontal and rotational adjustment of the bumper with respect to the swimstep. One end of the adjustment bracket is releasable connected to the bumper by a clamp, which permits vertical and rotational adjustment of the bumper relative to the swimstep. The other end of the adjustment bracket is releasably connected to the mounting bracket at multiple horizontal positions. This permits horizontal adjustment of the bumper relative to the swimstep.

In other aspects of the invention, the docking apparatus includes an attachment hook at an upper portion of the bumper. The attachment hook serves as a point of connection for the line from the dinghy. The line may have a clasp or other suitable quick-release mechanism at one end for releasable connection to the attachment hook. This is especially convenient when docking the dinghy.

The docking apparatus securely docks both hard and soft dinghies to the swimstep. As a result, the dinghy is made as stable as possible to provide for safe loading and unloading of passengers.

The docking apparatus also prevents damage to the dinghy and the boat's swimstep in rough waters. In the first embodiment of the invention, which is used for docking soft dinghies, the bumper extends vertically above the swimstep and vertically below the swimstep, preferably to a location below the surface of the water. When the line is attached to the soft dinghy and the bumper to firmly abut the dinghy against the bumper, the relative vertical movement between them in rough waters is minimized. To the extent there is some relative vertical movement, the vertical extension of the bumper below the swimstep prevents the dinghy from being trapped under the swimstep and damaged. The vertical extension of the bumper above the swimstep also prevents the dinghy from moving on top of the swimstep.

In the second embodiment of the invention, the line also securely abuts the hard dinghy against the cushion of each bumper. The cushion is of sufficient vertical height to accommodate any relative movement between the hard dinghy and the cushion in rough waters. In this embodiment, the bumper and its associated cushion need not, necessarily extend below the surface of the water to prevent the dinghy from moving under the swimstep.

Other features and advantages of the present invention will become apparent from the following description, taken in conjunction with the accompanying drawings, which illustrate, by way of example, the principles of the invention.

BRIEF DESCRIPTION OF THE DRAWINGS

The accompanying drawings illustrate the invention. In such drawings.

DESCRIPTION OF THE PREFERRED EMBODIMENTS

Figure 1:
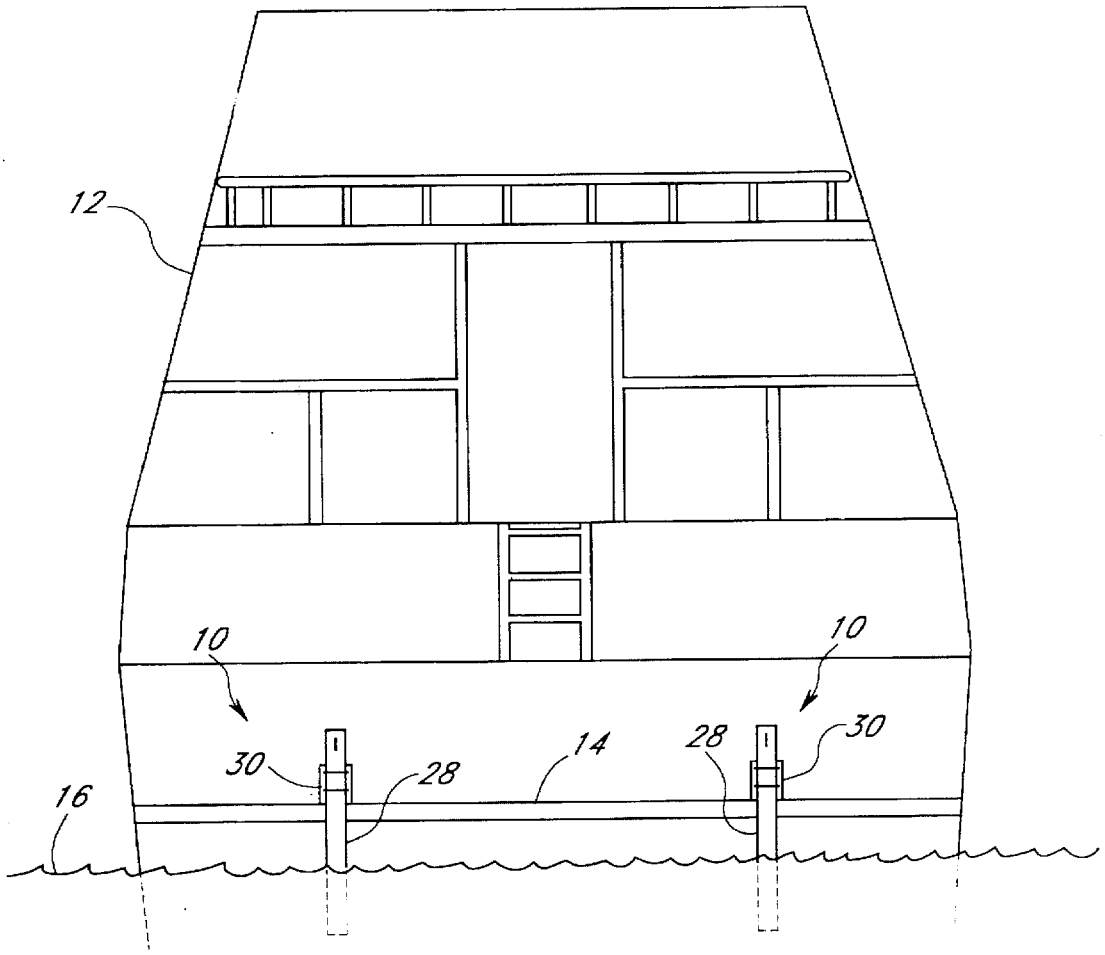
FIG. 1 is an elevational view of a first embodiment of a docking apparatus, embodying the novel features of the present invention, attached to a swimstep of a boat.

As shown in the exemplary drawings, the present invention is embodied in a docking apparatus, referred to generally by the reference numeral 10, for use in docking boats to each other. In particular, the docking apparatus 10 is designed to connect a smaller vessel to a horizontal platform extending from a larger vessel. In the description set forth below, the docking apparatus will be described and explained with reference to its use for connecting a dinghy to a swimstep of a boat.

Two embodiments of the invention are described below. The first embodiment of the docking apparatus, shown in FIGS. 1–3 and 7, is used for docking soft dinghies to the swimstep of a boat. The second embodiment of the docking apparatus, shown in FIGS. 4–6 and 8, is used for docking hard dinghies to the swimstep of a boat.

Figure 2:
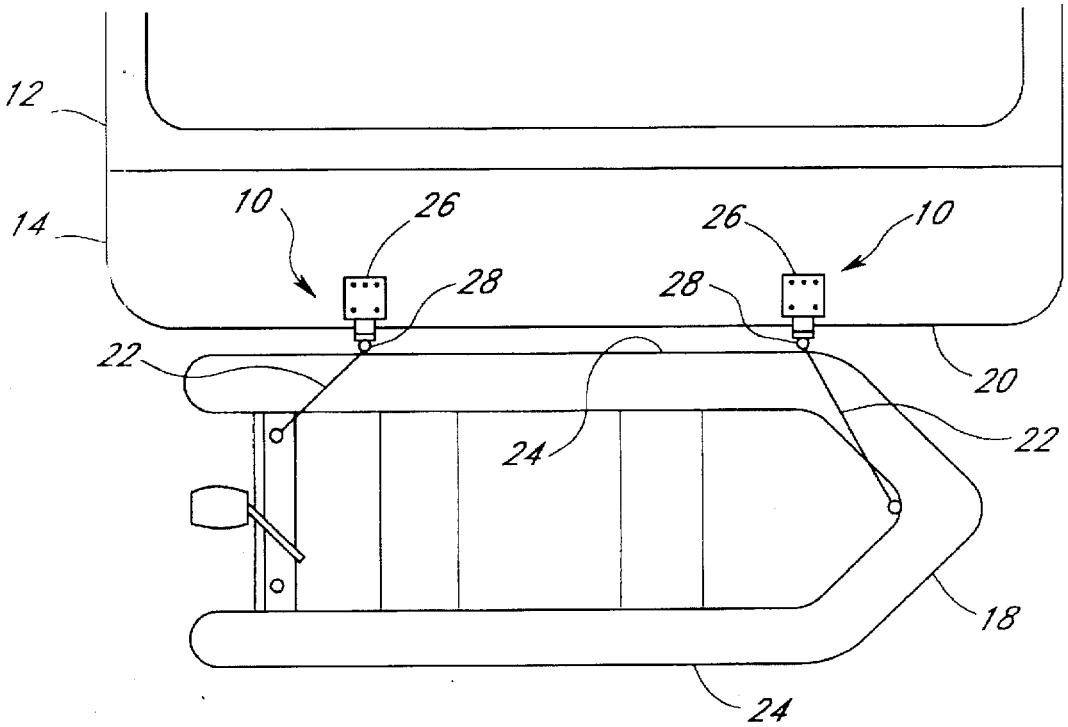
FIG. 2 is a plan view of the docking apparatus of FIG. 1, in which a soft dinghy is docked to the swimstep of the boat by the docking apparatus.
Figure 3:
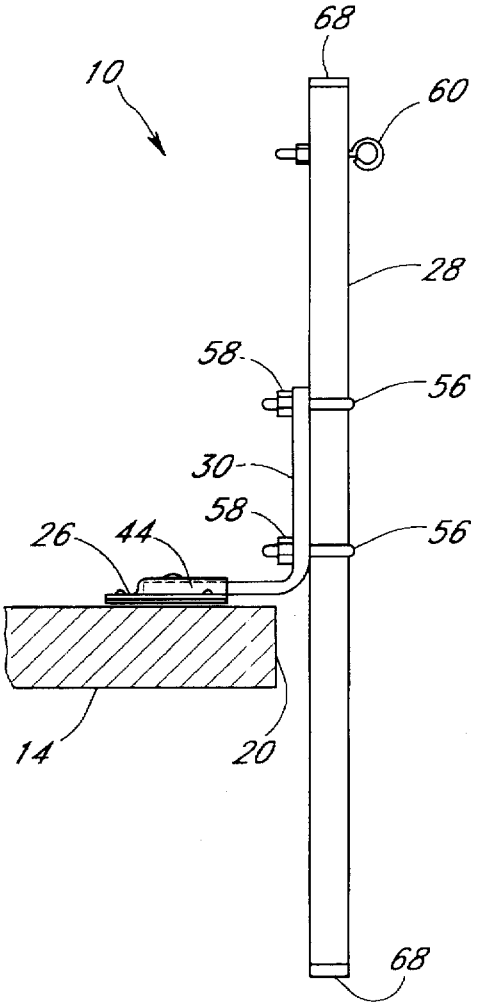
FIG. 3 is another elevational view of the docking apparatus of FIG. 1, shown connected to the swimstep of the boat.

FIGS. 1–3 illustrate the first embodiment of the docking apparatus 10. FIG. 1 shows a boat 12 having a horizontal platform or swimstep 14 located above the surface 16 of the water. The docking apparatus 10 is connected to the swimstep 14 for docking a soft dinghy 18, as shown in FIG. 2. In the preferred embodiment, there is a docking apparatus 10 secured to an outer edge 20 of the swimstep 14 at two spaced locations. By sufficiently spacing each docking apparatus 10, increased stability is provided when connecting the soft dinghy 18 to the docking apparatus by a line 22.

In general, a soft dinghy 18 is characterized by its side rails 24, which are soft. One common form of soft dinghy 18 has tubular side rails 24 inflated with air. As a result, the side rails 24 of the soft dinghy 18 provide a natural cushion or buffer when docked against the docking apparatus 10. In this regard, the spacing between each docking apparatus 10 on the swimstep 14 should be wide enough to provide as much stability as possible, but close enough so that the side rails 24 of the soft dinghy 18 will abut against each docking apparatus. The proper spacing of each docking apparatus 10 will be apparent to those of ordinary skill in the art familiar with docking vessels such as dinghies.

Figure 7:
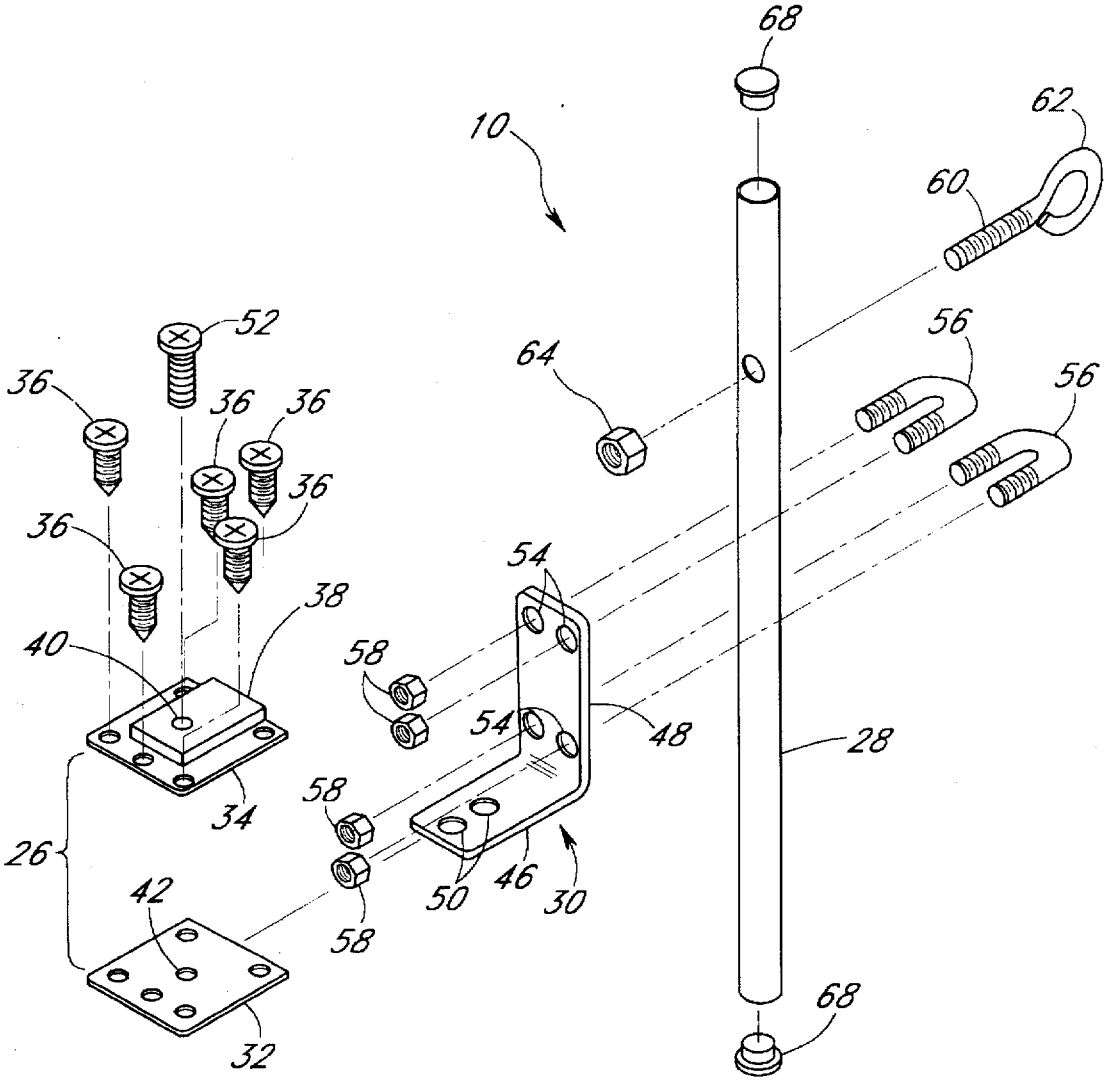
FIG. 7 is an exploded view of the first embodiment of the docking apparatus, of FIG. 1.
Figure 8:
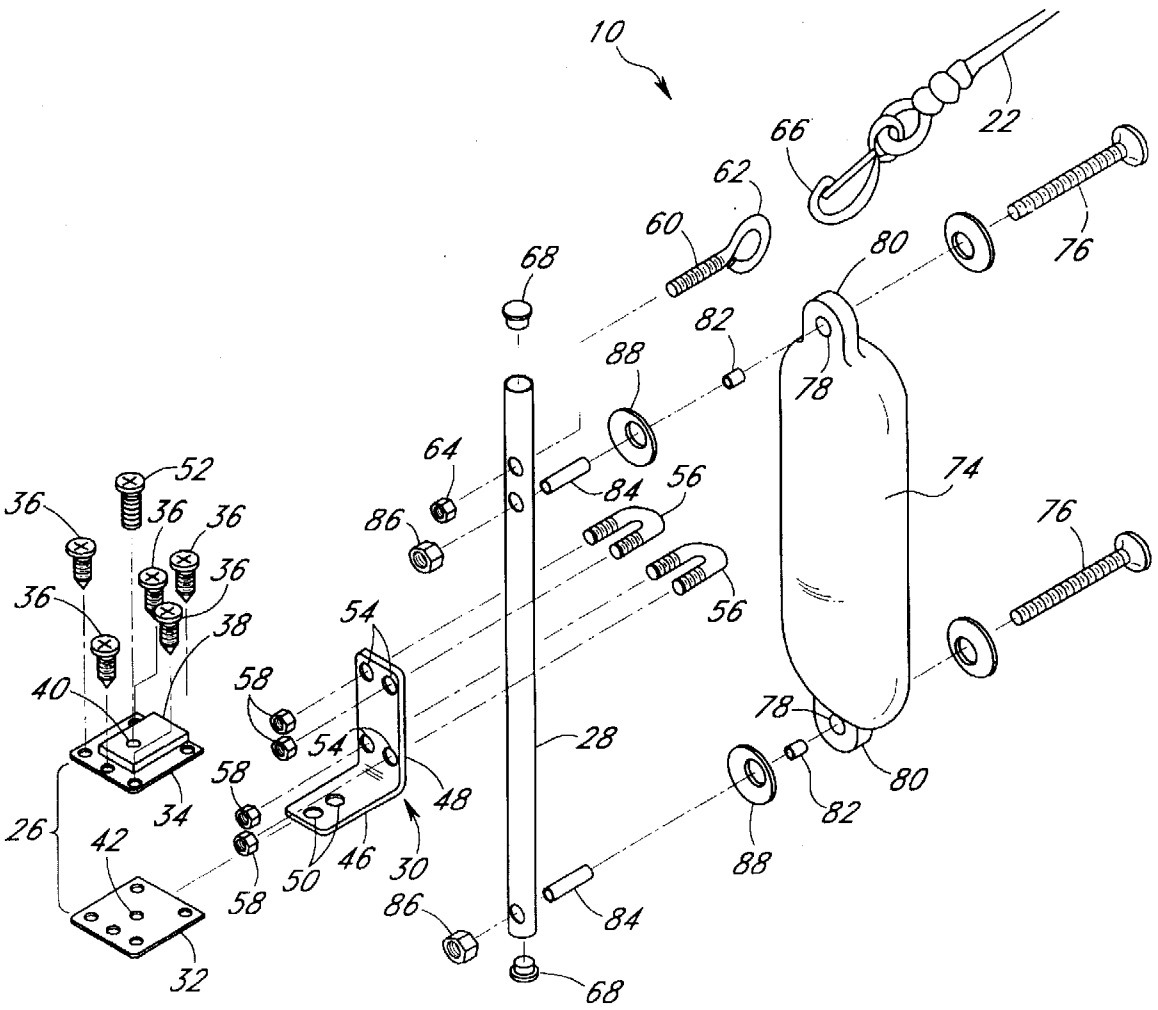
FIG. 8 is an exploded view of the second embodiment of the docking apparatus of FIG. 4.

As shown in FIGS. 3 and 7, each docking apparatus 10 comprises a mounting bracket 26 connected to the outer edge 20 of the swimstep 14, and an elongated tubular member or bumper 28 extending vertically above and below the swimstep. An adjustment bracket 30 connects the bumper 28 to the mounting bracket 26 and enables a plurality of adjustments of the docking apparatus 10.

With particular reference to FIG. 7, the mounting bracket 26 comprises a lower plate 32 and an upper plate 34 connected to each other and to the swimstep 14 by screws 36. The upper plate 34 includes a raised rectangular portion 38 with a substantially central hole 40 that aligns with another central hole 42 in the lower plate 32. When the upper plate 34 is connected to the lower plate 32, the raised rectangular portion 38 and the lower plate 32 define a rectangular slot 44. This slot 44 faces away from the boat 12 and toward the dinghy 18 to be docked.

The adjustment bracket 30 is generally L-shaped and includes a horizontal portion 46 and vertical portion 48. The horizontal portion 46 is received within the slot 44 of the mounting bracket 26 and may be secured to the mounting bracket at one of two horizontal locations. These horizontal locations are defined by two holes 50 in the horizontal portion 46 of the adjustment bracket 30. By appropriate alignment of one of the holes 50 in the horizontal portion 46 of the adjustment bracket 30 with the substantially central hole 40 in the upper plate 34 of the mounting bracket 26, the adjustment bracket may be secured by a screw 52 to the mounting bracket at one of two different horizontal positions. This feature permits horizontal adjustment of the docking apparatus 10 relative to the swimstep 14, such that the bumper 28 of the docking apparatus may be positioned horizontally closer to or further away from the swimstep.

The vertical portion 48 of the adjustment bracket 30 has a plurality of holes 54 for receiving U-shaped clamps 56. These U-shaped clamps 56 surround the bumper 28 and fasten it to the vertical portion 48 of the adjustment bracket 30 by nuts 58 which engage threaded ends of the U-shaped clamps. By loosening the nuts 58, vertical adjustment of the bumper 28 with respect to the swimstep 14 is permitted. In general, when a soft dinghy 18 will be docked to the swimstep 14, it is desirable to position the bumper 28 relative to the swimstep such that at least a portion of the lower end of the bumper extends below the surface 16 of the water. In this way, the bumper 28 will prevent the dinghy 18 from moving underneath the swimstep 14 when a rough water condition exists.

The upper portion of the bumper 28 has an attachment hook 60 with a generally round eyelet 62. The attachment hook 60 may be connected to the bumper 28 by a nut 64 or other appropriate means. The attachment hook 60 is designed to receive the line 22 from one end of the soft dinghy 18. If desired, the end of the line may have a clasp 66 or other quick-release mechanism for connection to the attachment hook 60. Such a clasp 66 facilitates docking of the soft dinghy 18 to the docking apparatus 10.

In the embodiment of the docking apparatus 10 illustrated in the drawings, the bumper 28 is shown as a hollow tubular member. However, it will be appreciated that other types of vertical members may be used, and the bumper 28 need not be tubular in construction. If the hollow tubular member is used as the bumper 28, plastic end caps 68 may be provided to finish off the ends of the tube for cosmetic reasons and to prevent injury. In this regard, the upper portion of the bumper 28 may be used as a handrail by passengers who are loading into or unloading from the dinghy 18. The plastic end cap 68 will prevent a passenger's finger from becoming inserted into the tubular bumper 28 and broken during an accidental fall, or from becoming cut on the edges of the bumper, and so forth.

Figure 5:
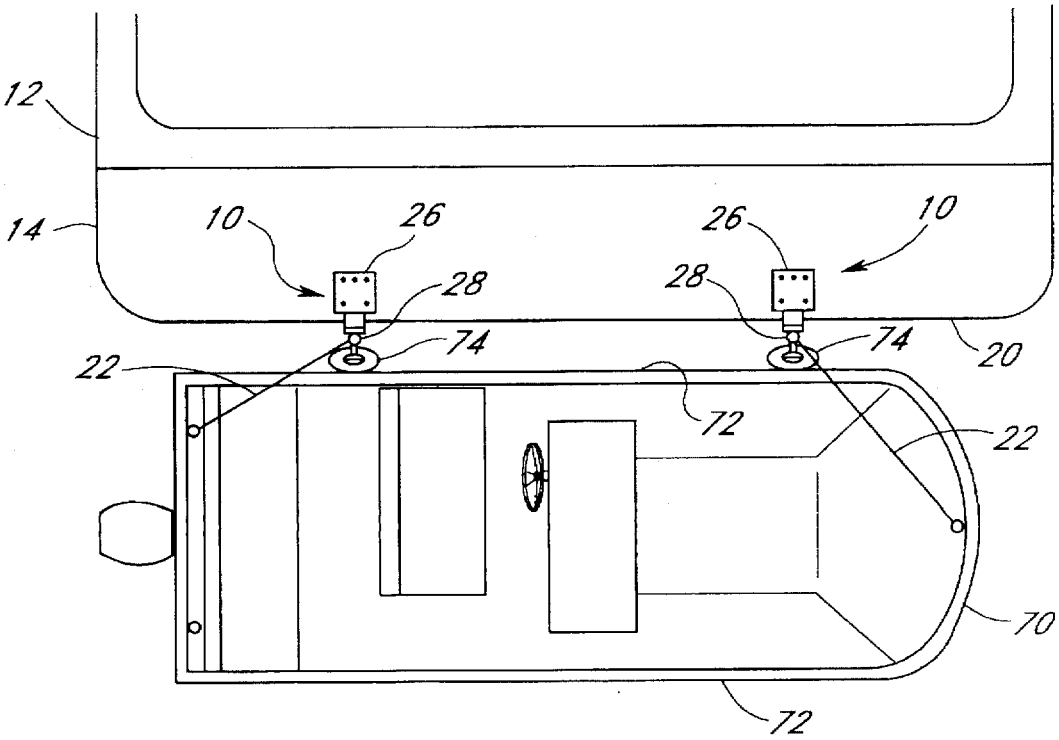
FIG. 5 is a plan view of the docking apparatus of FIG. 4, in which a hard dinghy is docked to the swimstep of the boat by the docking apparatus.
Figure 4:
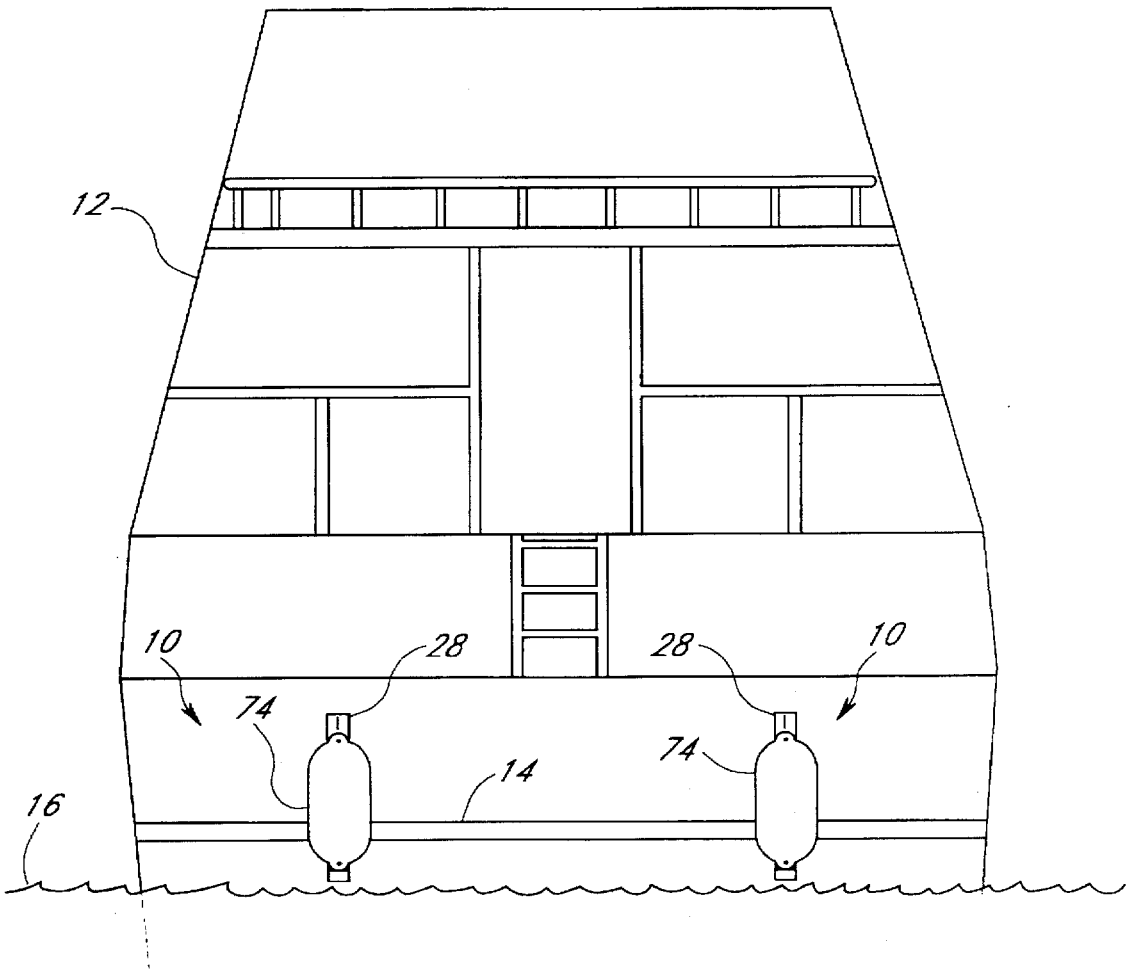
FIG. 4 is an elevational view of a second embodiment of the docking apparatus, also shown connected to the swimstep of a boat.

FIGS. 4–6 and 8 show the second embodiment of the docking apparatus 10 for docking a hard dinghy 70 to the swimstep 14 of the boat 12. In this regard, FIG. 4 shows the boat 12, its swimstep 14, and the docking apparatus 10 connected to the swimstep at spaced apart locations. Similarly, FIG. 5 shows the hard dinghy 70 connected by lines 22 to each docking apparatus 10. The hard dinghy 70 is characterized by its side rails 72, which are made of a hard material, such as plastic, fiberglass or wood. Therefore, it is necessary to provide a cushion or buffer when docking the hard dinghy 70 to the swimstep 14, to prevent damage.

Figure 6:
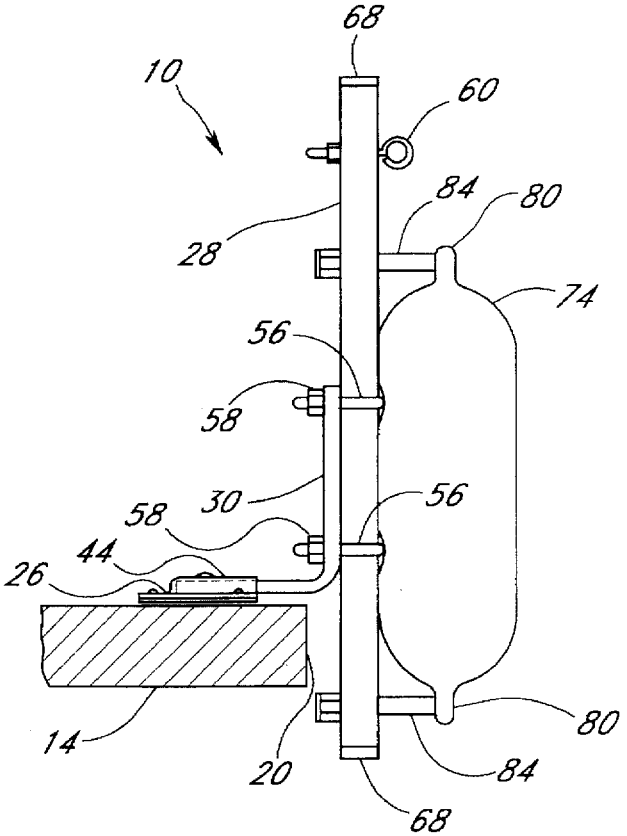
FIG. 6 is another elevational view of the docking apparatus of FIG. 4, shown connected to the swimstep of the boat.

As shown in FIG. 6, the docking apparatus 10 for hard dinghies 70 comprises a mounting bracket 26 and an adjustment bracket 30, which are identical to the first embodiment discussed above. Therefore, the structure and functions of the mounting bracket 26 and adjustment bracket 30 will not be described again. In the second embodiment, however, the bumper 28 is shorter and need not extend below the surface 16 of the water. In general, for hard dinghies 70, it is sufficient that the bumper 28 extend only slightly below the swimstep 14, as shown in FIG. 6.

To provide a buffer between the side rails 72 of the hard dinghy 70 and the bumper 28, the docking apparatus 10 for hard dinghies includes a cushion 74 connected to the bumper. The cushion 74, which is also commonly referred to as a fender, may take one of several forms. For example, it may comprise a tubular plastic body inflated with air, such that it may be compressible by a limited amount. Alternatively, the cushion 74 may comprise a body of foam, preferably with a plastic skin to prevent wear. Other suitable forms of the cushion 74 will be apparent to those of skill in the art.

The cushion 74 is connected to the bumper 28 by a bolt 76 passing through a hole 78 in a tab 80 at each end of the cushion. The hole 78 in each tab 80 may have a metal sleeve 82 that receives the bolt 76. A tubular spacer 84 also may be provided to properly support the tabs 80 in a spaced position from the bumper 28. The bolts 76 are connected to the bumper 28 by nuts 86, and washers 88 may be provided on opposite sides of each tab 80 to provide a secured connection and prevent wear.

As with the first embodiment, the second embodiment of the docking apparatus 10 is horizontally and vertically adjustable with respect to the swimstep 14. Horizontal adjustment of the bumper 28 and its associated cushion 74 is provided by appropriate positioning of the horizontal portion 46 of the adjustment bracket 30 within the mounting bracket 26, as described above. Similarly, vertical adjustment of the bumper 28 and its associated cushion 74 is accomplished by loosening of the nuts 58 on the U-shaped clamps 56 sufficient to permit sliding adjustment of the bumper 28. Once the adjustment has been made, the nuts 58 can be tightened again.

In addition to the horizontal and vertical adjustments described above, rotational adjustment of the bumper 28 with respect to the swimstep 14 is also provided. Upon loosening of the U-shaped clamps 56, the bumper 28 can move vertically up and down, and it can rotate about its axis. This rotation permits the cushion 74 to also rotate relative to the swimstep 14. In this way, the hard dinghy 70 can be docked closer to or farther away from the swimstep 14, depending upon the rotational position of the cushion 74.

For example, when it is desired to dock the hard dinghy 70 as close as possible to the swimstep 14, such as a swimstep having a substantially straight outer edge 20, the cushion 74 may be rotated as far as possible, to one side or the other, against the swimstep. If necessary, a fine-tuning horizontal adjustment also may be provided by proper position of the adjustment bracket 30 as far as possible within the mounting bracket 26. This results in minimizing the space between the side rails 72 of the hard dinghy 70 and the swimstep 14. Alternatively, when maximum spacing of the hard dinghy 70 from the swimstep 14 is desired, such as in swimsteps having a curved outer edge (not shown), the cushion 74 may be rotationally positioned such that it directly faces the hard dinghy 70. This allows maximum spacing between the swimstep 14 and the hard dinghy 70 to accommodate the curvature of the swimstep 14, or for other reasons that may be appropriate under the circumstances.

From the foregoing, it will be appreciated that the present invention provides a docking apparatus 10 for quickly and conveniently docking both hard and soft dinghies 18 and 70 to the swimstep 14 of a boat 12. The docking apparatus 10 securely docks the dinghies in a way that minimizes instability and thereby allows loading and unloading of passengers in a safe manner. In addition, damage to the dinghies in rough waters is avoided. Moreover, the docking apparatus 10 is fully adjustable, vertically, horizontally, to optimize the docking procedure and tailor it to various types of boats 12 and their swimsteps 14, which may have a straight outer edge 20 or may be curved.

While a particular form of the invention had been illustrated and described, it will be apparent that various modifications can be made without departing from the spirit and scope of the invention. Accordingly, it is not intended that the invention be limited, except as by the appended claims.

I claim:

1. A docking apparatus for docking a smaller vessel to a substantially horizontal platform of a larger vessel, comprising:

(a) a mounting bracket attached to an outer edge of the platform of the larger vessel;

(b) a substantially vertical bumper attached to the mounting bracket such that the bumper extends vertically above and below the platform;

(c) an adjustment bracket connected between the bumper and the mounting bracket to permit vertical and horizontal adjustment of the bumper with respect to the platform, wherein the adjustment bracket is adapted to be connected to the mounting bracket at different horizontal positions relative to the platform; and (d) a line connecting the smaller vessel to the bumper to thereby dock the smaller vessel to the platform of the larger vessel.

2. The docking apparatus of claim 1, further comprising a cushion connected to the bumper to provide a cushion between the smaller vessel and the bumper.

3. The docking apparatus of claim 2, wherein the cushion is vertically adjustable with respect to the platform.

4. The docking apparatus of claim 2, wherein the cushion is rotationally adjustable with respect to the platform.

5. The docking apparatus of claim 2, wherein the bumper is releasably connected to the adjustment bracket by a clamp that permits vertical and rotational adjustment of the cushion relative to the platform.

6. The docking apparatus of claim 2, wherein the smaller vessel comprises a hard dinghy.

7. The docking apparatus of claim 1, wherein the bumper is releasably connected to the adjustment bracket by a clamp that permits vertical adjustment of the bumper relative to the platform.

8. The docking apparatus of claim 1, further comprising an attachment hook at an upper portion of the bumper for connection to the line.

9. The docking apparatus of claim 8, wherein the line has clasp at one end for releasable connection to the attachment hook.

10. The docking apparatus of claim 1, wherein the platform comprises a swimstep.

11. The docking apparatus of claim 1, wherein the smaller vessel comprises a soft dinghy.

12. A docking apparatus for docking a smaller vessel to a substantially horizontal platform of a larger vessel, comprising:

(a) a mounting bracket attached to an outer edge of the platform;

(b) a substantially vertical bumper attached to the mounting bracket such that the bumper extends vertically above and below the platform;

(c) a cushion connected to the bumper to provide a cushion between the smaller vessel and the bumper; and (d) a line connecting the smaller vessel to the bumper to thereby dock the smaller vessel to the platform of the larger vessel.

13. The docking apparatus of claim 12, wherein the cushion is horizontally, vertically and rotationally adjustable with respect to the platform.

14. The docking apparatus of claim 12, further comprising an adjustment bracket for connecting the bumper to the mounting bracket, wherein one end of the adjustment bracket is releasably connected to the bumper by a clamp, to thereby permit vertical and rotational adjustment of the cushion to the platform, and wherein the other end of the adjustment bracket is releasably connected to the mounting bracket at multiple horizontal positions, to thereby permit horizontal adjustment of the cushion relative to the platform.

15. A docking apparatus for docking a soft dinghy to a swimstep of a boat, comprising:

(a) a pair of mounting brackets attached at spaced locations to an outer edge of the swimstep;

(b) a substantially vertical bumper attached to each mounting bracket such that the bumper can be vertically adjusted to extend above and below the swimstep;

(c) an adjustment bracket for connecting each bumper to its associated mounting bracket, wherein one end of the adjustment bracket is releasably connected to the bumper to thereby permit vertical adjustment of the bumper relative to the swimstep, and wherein the other end of the adjustment bracket is releasably connected to the mounting bracket to thereby permit horizontal adjustment of the bumper relative to the swimstep; and (d) a line connecting the soft dingy to each bumper to thereby dock the soft dinghy to the swimstep of the boat.

16. A docking apparatus for docking a hard dinghy to a swimstep of a boat, comprising:

(a) a pair of mounting brackets attached at spaced locations to an outer edge of the swimstep;

(b) a substantially vertical bumper attached to each mounting bracket such that the bumper can be vertically adjusted relative to the swimstep;

(c) a cushion connected to each bumper to provide a cushion between the hard dinghy and the bumper; and (d) a line connecting the hard dinghy to each bumper to thereby dock the hard dinghy to the swimstep of the boat.

17. The docking apparatus of claim 16, further comprising an adjustment bracket for connecting each bumper to its associated mounting bracket, wherein one end of the adjustment bracket is releasably connected to the bumper by a clamp, to thereby permit vertical and rotational adjustment of the cushion relative to the swimstep, and wherein the other end of the adjustment bracket is releasably connected to the mounting bracket at multiple horizontal positions, to thereby permit horizontal adjustment of the cushion relative to the swimstep.

18. A docking apparatus for docking a smaller vessel to a substantially horizontal platform of a larger vessel, comprising:

(a) a mounting bracket attached to an outer edge of the platform of the larger vessel;

(b) a substantially vertical bumper attached to the mounting bracket such that the bumper extends vertically above and below the platform;

(c) an adjustment bracket connected between the bumper and the mounting bracket to permit vertical and horizontal adjustment of the bumper with respect to the platform;

(d) a cushion connected to the bumper to provide a cushion between the smaller vessel and the bumper; and (e) a line connecting the smaller vessel to the cushion to thereby dock the smaller vessel to the platform of the larger vessel.

* * * * *